United States Patent [19]

Tsamas et al.

[11] Patent Number: 4,667,379

[45] Date of Patent: May 26, 1987

[54] JEWELRY CLASP

[75] Inventors: Anton Tsamas, Hackensack, N.J.; Eric R. Bone; Andrew Stevens, both of Suffolk, England; Salvatore Tumminello, Jr., 32 Henry St., Lodi, N.J. 07644

[73] Assignee: Salvatore Tumminello, Jr., Lodi, N.J.

[21] Appl. No.: 863,091

[22] Filed: May 14, 1986

[51] Int. Cl.[4] ..... A44B 11/25

[52] U.S. Cl. ..... 24/636; 24/633; 24/665

[58] Field of Search ..... 24/633, 636–642, 24/665

[56] References Cited

U.S. PATENT DOCUMENTS*

| | | | |
|---|---|---|---|
| 490,709 | 1/1893 | Froehlich | 24/637 X |
| 2,664,611 | 1/1954 | Shomber | 24/642 X |
| 3,413,692 | 12/1968 | Pressley | 24/640 X |
| 3,523,341 | 8/1970 | Spires | 24/637 X |
| 3,570,073 | 3/1971 | Cibie | 24/637 |
| 3,606,456 | 9/1971 | Cazabon | 24/637 X |
| 3,935,618 | 2/1976 | Fohl | 24/642 X |
| 4,033,015 | 7/1977 | Uwe et al. | 24/642 |
| 4,454,634 | 6/1984 | Haglund et al. | 24/636 |
| 4,575,908 | 3/1986 | Gloomis et al. | 24/633 X |

*Primary Examiner*—Kenneth J. Dorner
*Assistant Examiner*—James R. Brittain
*Attorney, Agent, or Firm*—Samuelson & Jacob

[57] ABSTRACT

A jewelry clasp in which a blade member is captured in a case member by a latch normally located in a latched position to secure the blade member in the case member, the latch being displaceable along a first direction in response to movement of the blade member into the case member for latching purposes and displaceable along a second direction transverse to the first direction, in response to a selectively moved actuator, for unlatching purposes, to selectively release the blade member from the case member, a first spring biases the latch along the first direction and a second spring biases the latch along the second direction for maintaining the latch in the latched position, and a safety lock is movable selectively from an unlocked position into a locked position for precluding inadvertent unlatching, while permitting latching independent of the position of the safety lock.

19 Claims, 12 Drawing Figures

JEWELRY CLASP

The present invention relates generally to clasps and pertains, more specifically, to jewelry clasps for securing together and selectively releasing the terminal ends of a jewelry strand, such as a bracelet or a necklace.

Clasps for ornamental items to be worn on the person have been the subject of much development throughout the very many years over which people have decorated themselves with bracelets, necklaces and like articles. Where these articles are in the form of relatively fine strands having portions which are to be attached together and selectively detached from one another, the clasps which are utilized for the attachment should have small dimensions so as to be aesthetically compatible with the fine strands of the articles. At the same time, these clasps must provide a secure attachment in order to preclude inadvertent detachment and consequent loss of the ornamental article. In addition, the clasps should be detached easily, when desired, without sacrificing the ability of the clasps to maintain a secure attachment. Further, the construction of these clasps should be amenable to the judicious use of precious or semi-precious metal component parts.

It is an object of the present invention to provide a jewelry clasp capable of economical construction in small dimensions for use in connection with relatively fine jewelry strands.

Another object of the invention is to provide a jewelry clasp of the type described and which enables use of a secure attachment, and strongly resists detachment, yet is compact and economically manufactured of precious or semiprecious metals.

Still another object of the invention is to provide a compact jewelry clasp which is aesthetically compatible with a wide variety of ornamental articles of small dimensions.

Yet another object of the invention is to provide a jewelry clasp which is simple in operation, unobtrusive in use and adaptable for use with a wide variety of ornamental strands.

A further object of the invention is to provide a jewelry clasp which is compact in appearance, yet rugged enough in construction to withstand frequent use over an extended service life.

A still further object of the invention is to provide a jewelry clasp having a minimum number of component parts capable of economical manufacture and assembly in large quantities of uniform high quality.

The above objects, as well as still further objects and advantages, are attained by the present invention which may be described briefly as a jewelry clasp for securing together and selectively releasing opposed portions of a jewelry strand, the clasp comprising: a first clasp member for being affixed to one of the opposed portions; a second clasp member for being affixed to the other of the opposed portions, the second clasp member being receivable within the first clasp member and movable longitudinally along a path of travel extending into the first clasp member, for advancement to an engaged position where the second clasp member is captured and secured against retraction from the first clasp member, and for selective retraction from the engaged position; a retainer within the first clasp member, the retainer normally located in a latched position within the path of travel and displaceable out of the path of travel in an altitudinal direction transverse to the longitudinal direction, and in a lateral direction transverse to each of the longitudinal direction and the altitudinal direction; first resilient biasing means biasing the retainer in the altitudinal direction toward the latched position with a first resilient biasing force; second resilient biasing means biasing the retainer in the lateral direction toward the latched position with a second resilient biasing force; displacement means on the second clasp member for engaging the retainer to displace the retainer out of the path of travel in the altitudinal direction, against the first resilient biasing force, in response to advancement of the second clasp member toward the engaged position; a keeper on the second clasp member for receiving the retainer upon arrival of the second clasp member at the engaged position and return of the retainer to the latched position in response to the first resilient biasing force; and an actuator mounted for movement on the first clasp member and coupled with the retainer for selective displacement of the retainer out of the path of travel in the lateral direction, against the second resilient biasing force, in response to movement of the actuator, for selectively disengaging the retainer from the keeper and freeing the second clasp member for retraction from the first clasp member to release the opposed portions of the jewelry strand.

The invention will be understood more fully, while still further objects and advantages thereof will become apparent, in the following detailed description of a preferred embodiment illustrated in the accompanying drawing, in which.

Figure 1:
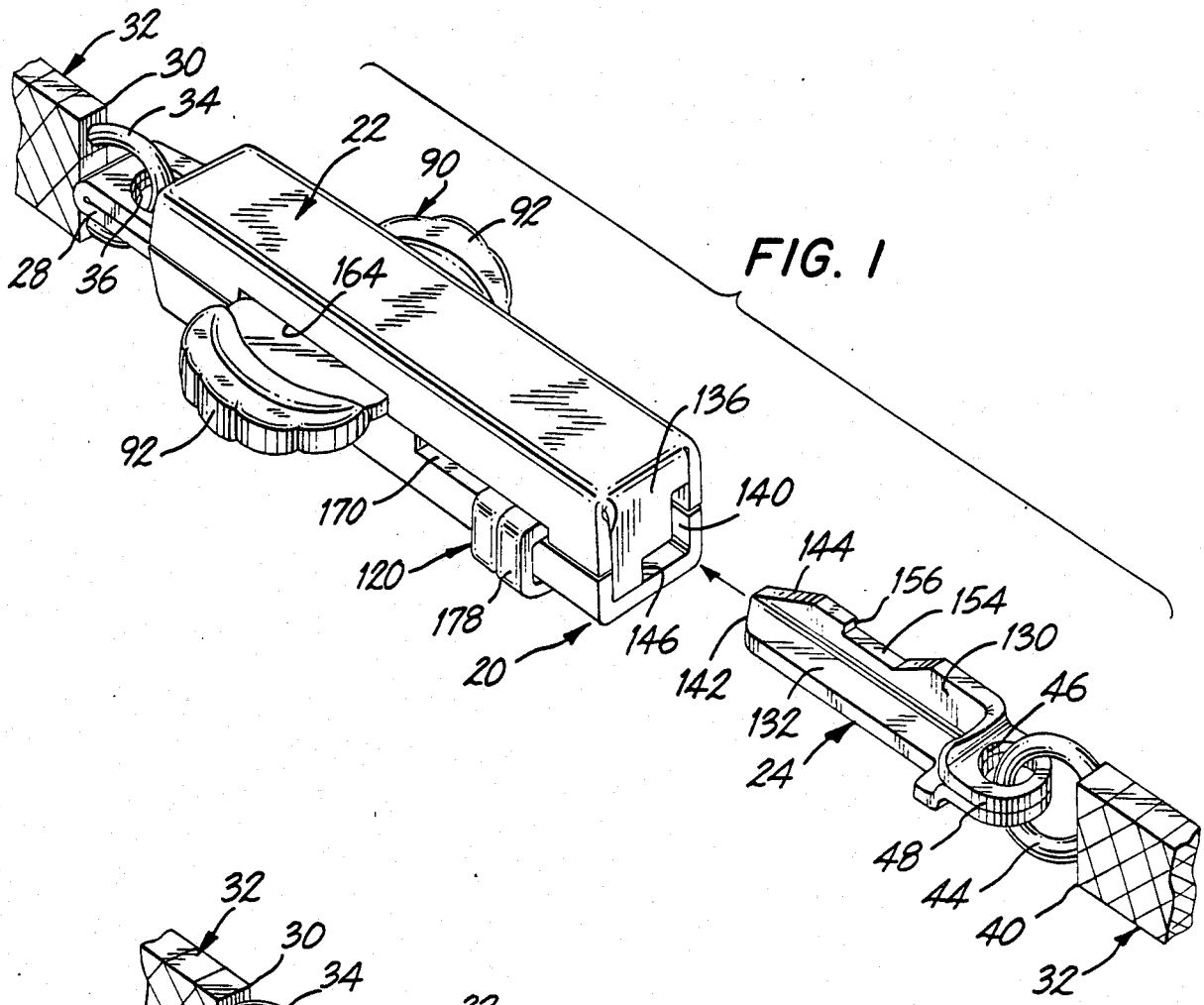
FIG. 1 is a perspective view showing jewelry clasp members constructed in accordance with the invention, about to be attached for securing together the terminal ends of a jewelry strand.
Figure 2:
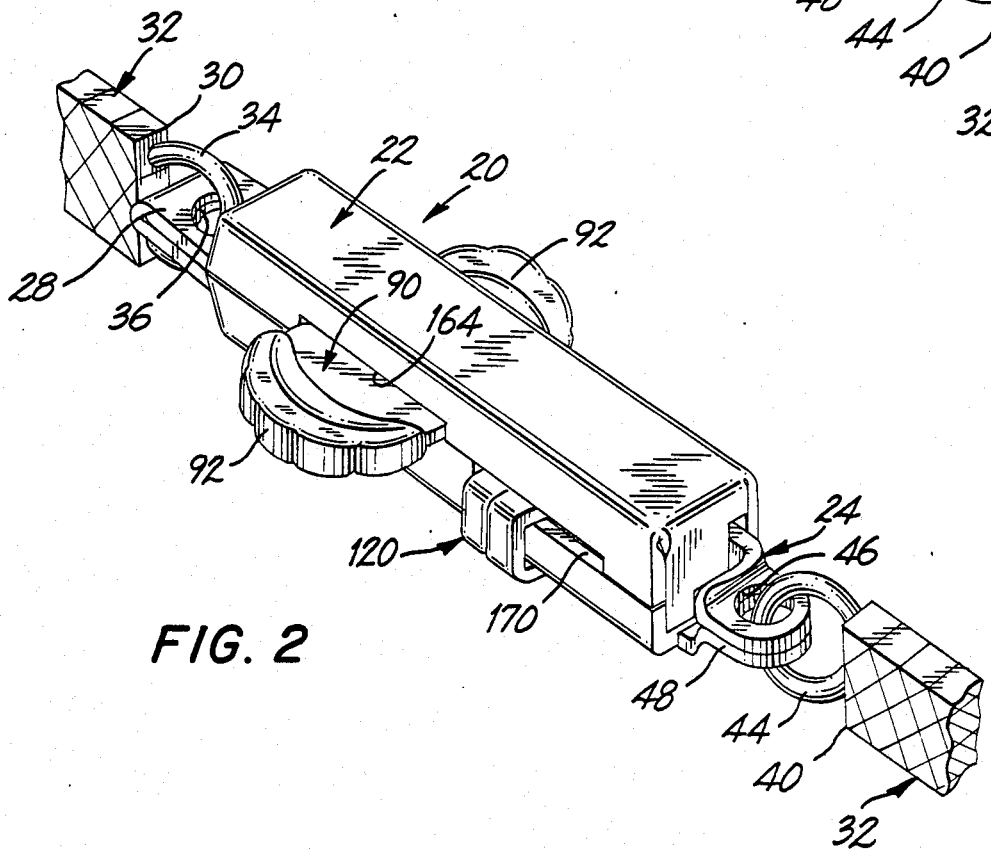
FIG. 2 is a perspective view similar to FIG. 1, but with the jewelry clasp members attached.

Referring now to the drawing, and especially to FIG. 1 thereof, a jewelry clasp constructed in accordance with the invention is shown at 20 and is seen to have a case member 22 and a blade member 24. Case member 22 includes an ear 28 enabling the case member 22 to be affixed to the terminal end 30 of a jewelry strand, shown in the form of a necklace 32, by means of a link 34 integral with terminal end 30 and passed through an aperture 36 in ear 28. In a similar manner, blade member 24 is provided with an ear 38 and is affixed to an opposed terminal end 40 of the necklace 32 by means of a link 44 integral with terminal end 40 and passed through an aperture 46 in ear 48. Thus, the case member 22 and blade member 24 are in place at opposed portions of necklace 32 for attaching together the opposed portions by moving the blade member 24, in the direction of the arrow, into case member 22. As seen in FIG. 2, the blade member 24 has been inserted fully into the case member 22, and locked therein, to secure together the terminal ends 30 and 40 of necklace 32.

Figure 3:
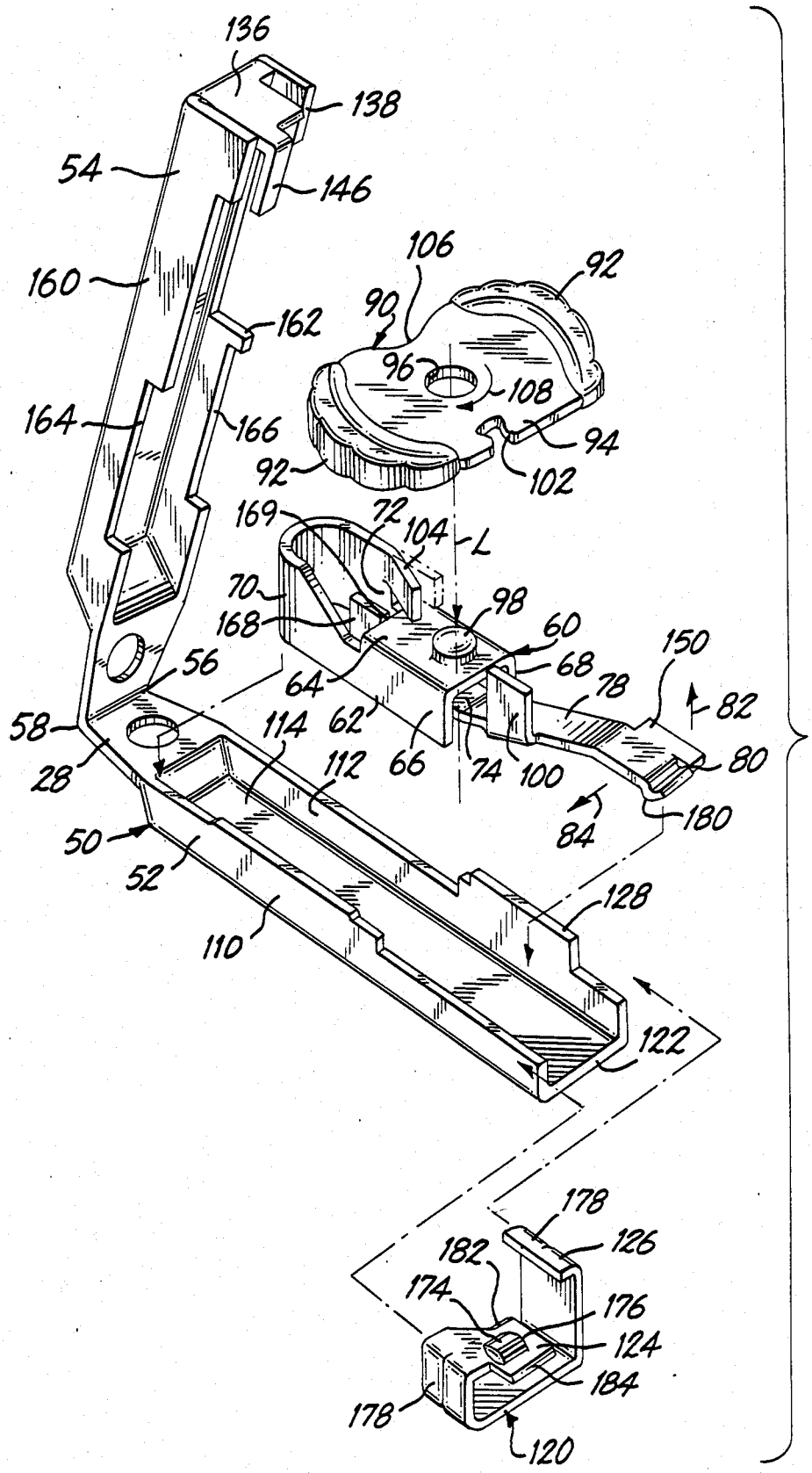
FIG. 3 is an exploded perspective view of one member of the jewelry clasp.

The mechanism by which the case member 22 and the blade member 24 selectively are attached and detached is best understood by first studying the construction of case member 22. Turning now to FIG. 3, case member 22 includes a casing 50 having a lower casing portion 52 and an upper casing portion 54 unitary with the lower casing portion 52 along a bend line 56, located at the rearward end 58 where ear 28 is placed. A multi-purpose one-piece spring member 60 is arranged to fit within the casing 50 in a manner to be explained further below. Spring member 60 has a base 62 located intermediate the ends of the spring member 60, the base 62 including a horizontal platform 64 and opposite vertical supports 66 and 68.

Figure 4:
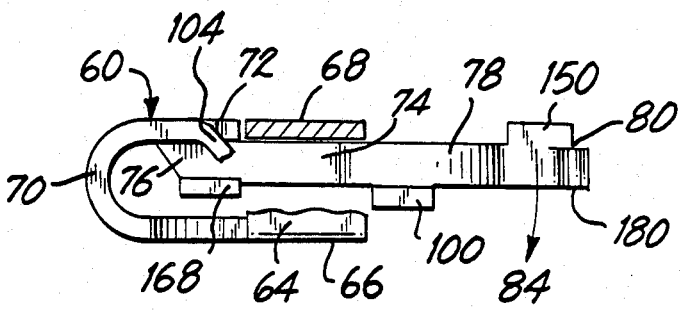
FIG. 4 is a top plan view, partially broken away, of one of the component parts of the member of FIG. 3.

A compression spring 70 is in the form of a laterally compressible U-shaped segment unitary with vertical support 66 and loops around toward vertical support 68, to a leg 72 which is free to move laterally relative to vertical support 68. As best seen in FIG. 4, as well as in FIG. 3, a cantilever arm 74 is unitary with spring 70 at a root 76 attached to leg 72 and extends longitudinally along a rising leaf spring 78 to an end 80. End 80 thus is movable resiliently in two directions relative to base 62: First, end 80 is movable vertically upwardly, in an altitudinal direction indicated by arrow 82 (see FIG. 3), against the downward biasing force of leaf spring 78. Second, end 80 is movable horizontally away from vertical support 68 and toward vertical support 66, in a lateral direction indicated by arrow 84, against the sideward biasing force of compression spring 70 which biases the cantilever arm 74 against vertical support 68.

Movement of the end 80 in the lateral direction indicated by arrow 84 is to be accomplished by an actuator shown in the form of a knob 90 having finger-grips 92 located at opposite edges of a disk 94 having a central aperture 96 which is to be journaled on a stub axle 98 unitary with and projecting upwardly from platform 64 to provide a pivot about an altitudinal axis of rotation L. Upon assembly of the knob 90 with the spring member 60, a finger 100, which is unitary with cantilever arm 74 and projects upwardly therefrom, is received within a notch 102 in disk 94. A tab 104 is bent from an initial position, shown in full lines in FIG. 3 (and in phantom in FIG. 5), in which initial position tab 104 falls within a recess 106 in disk 94 to enable knob 90 to be seated upon platform 64 with stub axle 98 journaled within aperture 96, to a retaining position, shown in phantom in FIG. 3 (and in full lines in FIG. 5), in which retaining position tab 104 overlies the disk 94 to capture knob 90 in place upon platform 64. Knob 90 then may be rotated selectively, in the direction of arrow 108, to move cantilever arm 74, and end 80 thereof, in the lateral direction away from vertical support 68, by virtue of the engagement of finger 100 by notch 102, against the resilient bias of U-shaped compression spring 70.

Figure 5:
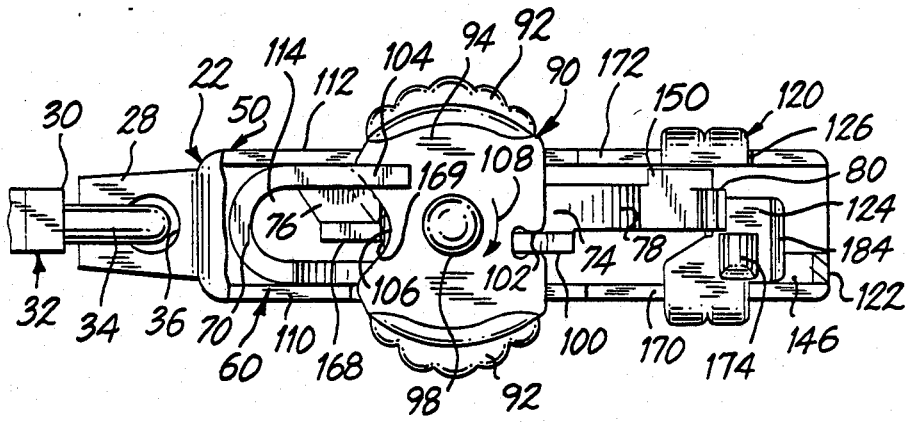
FIG. 5 is a plan view, partially broken away, of the member of FIG. 3 assembled.

As best seen in FIG. 5, as well as in FIG. 3, the assembled spring member 60 and knob 90 are placed within the lower casing portion 52 with the vertical supports 66 and 68 of base 62 fitted between the side walls 110 and 112 of the lower casing portion 52 and resting upon the bottom wall 114. A sliding safety lock member 120 is slipped over the forward end 122 of lower casing portion 52 so that a pad 124 carried by the lock member 120 slips beneath the end 80 of the cantilever arm 74. At the same time, a projection 126 located opposite pad 124 overlaps an upper edge 128 of the lower casing portion 52 to capture the lock member 120 upon casing 50. Once the assembled spring member 60 and the knob 90 are so placed within lower casing portion 52 and lock member 120 is slipped over the end 122, upper casing portion 54 is bent downwardly, along bend line 56, to close the casing 50 and complete an assembled case member 22, as illustrated in FIGS. 1 and 2.

Figure 6:
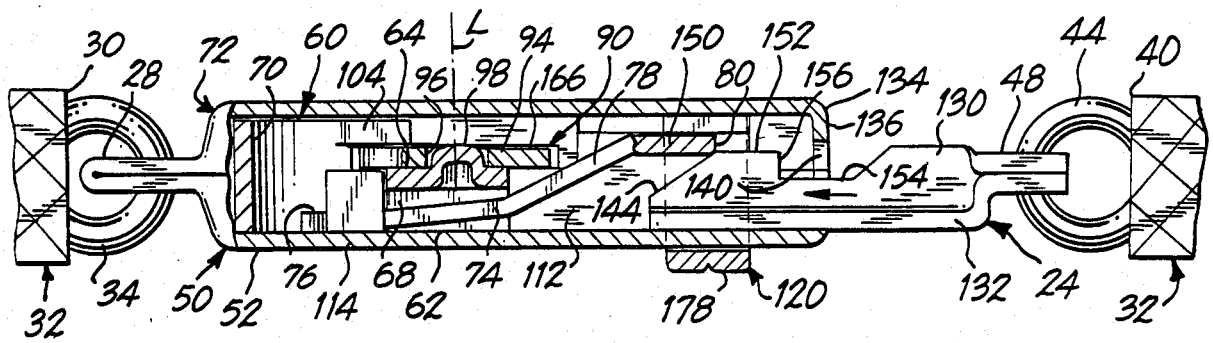
FIG. 6 is a longitudinal cross-sectional view of the jewelry clasp with the clasp members in the process of being attached.
Figure 7:
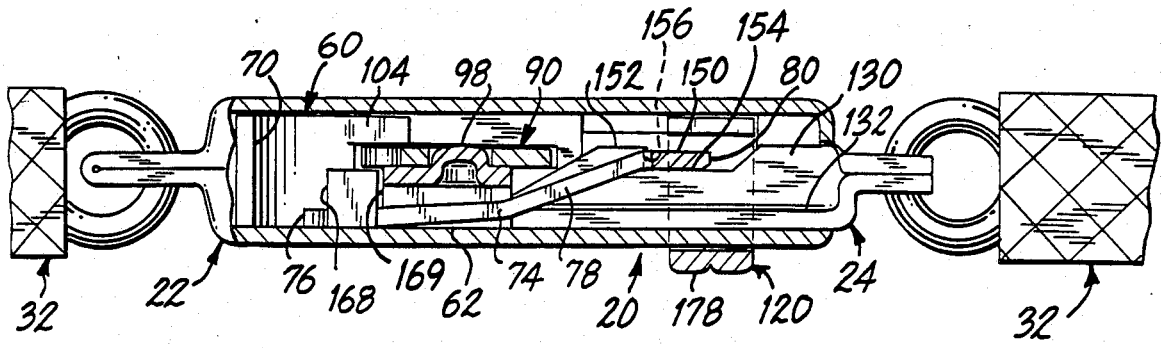
FIG. 7 is a view similar to FIG. 6, but with the clasp members fully attached.
Figure 8:
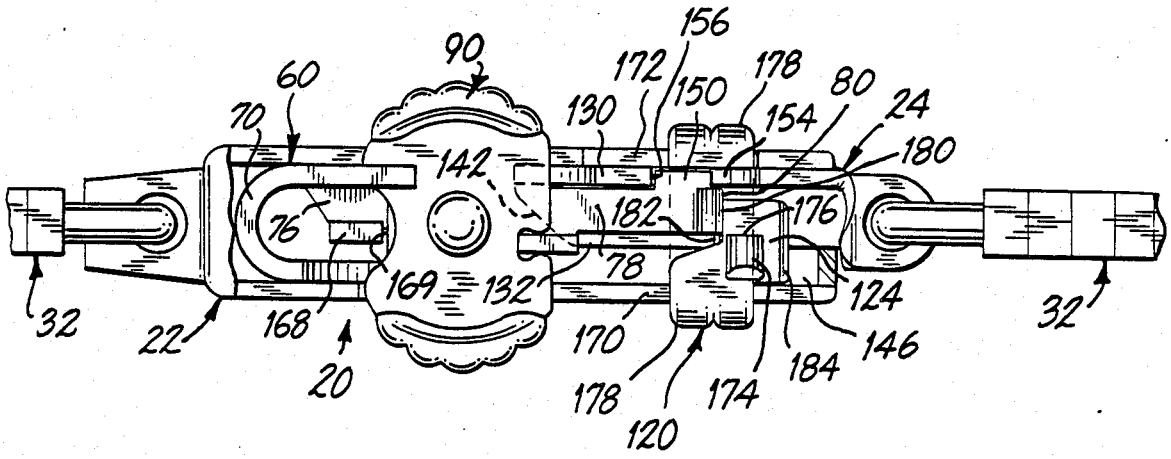
FIG. 8 is a plan view, partially broken away, of the clasp members as positioned in FIG. 7.

Turning now to FIGS. 6, 7 and 8, as well as to FIGS. 1 and 2, blade member 24 has a vertical web 130 and a horizontal flange 132 bent normal to the vertical web 130 so as to present an L-shaped cross-sectional configuration. Forward end 134 of upper casing portion 54 includes a vertical wall 136 having a L-shaped slot 138 so that upon completion of the case member 22, case member 22 is provided with an L-shaped opening 140 complementary to the L-shaped cross-sectional configuration of blade member 24. Thus, upon attachment of blade member 24 with case member 22, only the proper orientation of the blade member 24 relative to the case member 22 will permit insertion of the blade member 24 into the case member 22. Such insertion is facilitated by the tapered forward edge 142 of the flange 132 and an inclined ramp 144 along the forward portion of the web 130.

Upon insertion of the blade member 24 into case member 22, through opening 140, web 130 is guided for advancement along a longitudinal path of travel closely adjacent the side wall 112 of lower casing portion 52 by the configuration of opening 140 and by a guide bar 146 integral with the vertical wall 136 and extending inwardly into case member 22 (see FIG. 3). As blade member 24 is advanced into case member 22, displacement means in the form of ramp 144 will engage cantilever arm 74 adjacent the end 80 thereof and will displace end 80 altitudinally in an upward direction against the biasing force of leaf spring 78, as seen in FIG. 6, enabling a latch 150, which projects laterally from cantilever arm 74, to ride up ramp 144 and along the uppermost edge 152 of web 130 until blade member 24 reaches the fully-inserted position shown in FIG. 7 (and in FIG. 2). When the blade member 24 reaches the fully-inserted position, the latch 150 is registered with a notch 154 in web 130 and the biasing force of leaf spring 78 moves latch 150 into notch 154. A keeper, shown in the form of shoulder 156 of notch 154, then coacts with latch 150 to capture blade member 24 within case member 22, secured in the engaged position shown in FIG. 2, thereby securing together the ends 30 and 40 of necklace 32. The altitudinally upward and downward deflection of the latch 150 is accomplished independent of any movement of the knob 90 since finger 100 is free to slide altitudinally relative to notch 102 in disk 94.

Figure 9:
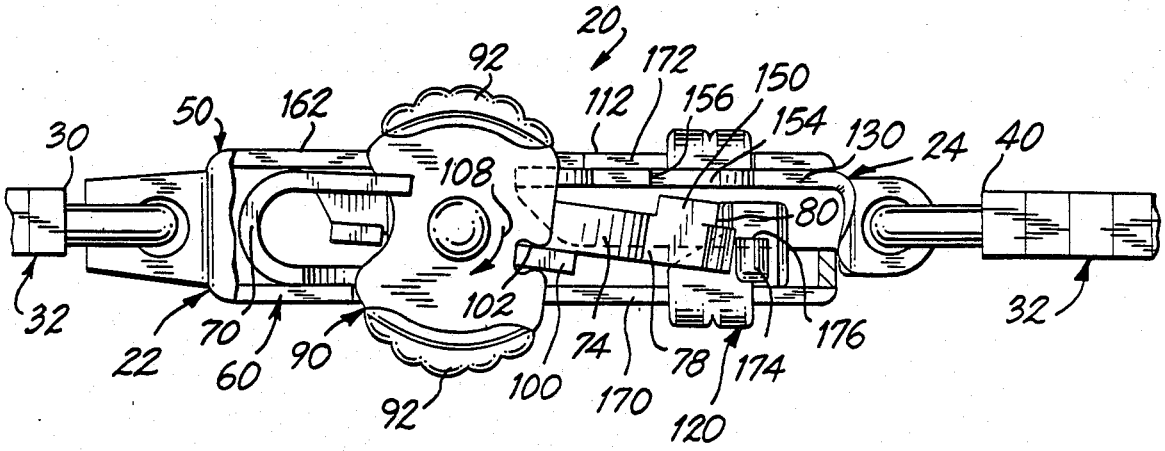
FIG. 9 is a view similar to FIG. 8, but with component parts being moved for selective detachment of the clasp members.
Figure 10:
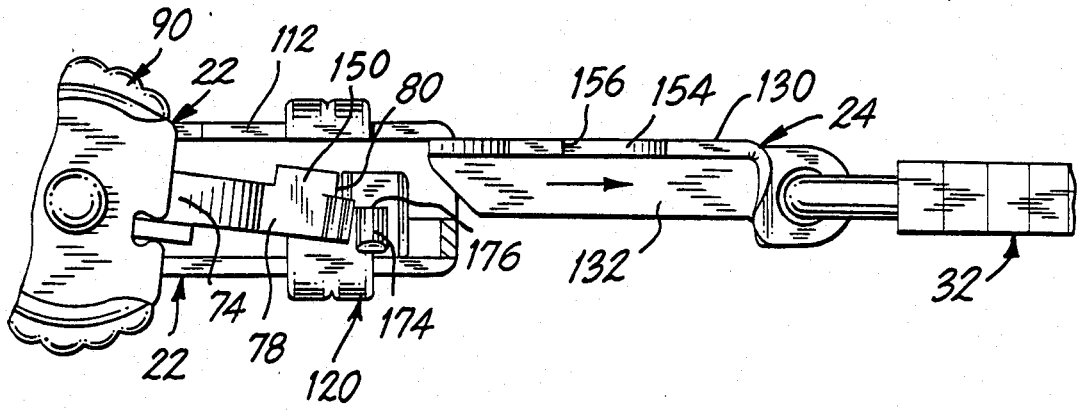
FIG. 10 is a fragmentary view similar to FIG. 9 showing the clasp members in the process of being detached.

Referring now to FIGS. 9 and 10, when it is desired to detach the ends 30 and 40 of necklace 32 from one another, blade member 24 is retracted from case member 22. Such retraction is accomplished by gripping finger-grips 92 of knob 90, which finger-grips 92 extend laterally beyond the side walls 160 and 162 of upper casing portion 54 by virtue of the projection of disk 94 through longitudinal slots 164 and 166 in the side walls 160 and 162. Knob 90 is rotated about the axis L provided by stub axle 98 and central aperture 96, in the direction of arrow 108 in FIG. 9, to displace notch 102 of the disk 94 and move finger 100 and cantilever arm 74 laterally, in the direction away from side walls 112 and 162, against the biasing force of U-shaped compression spring 70. Such lateral movement of cantilever arm 74 will displace end 80 of the cantilever arm 74 laterally and thereby withdraw latch 150 from notch 154, and out of the path of travel of web 130 so that shoulder 156 is released and blade member 24 may be retracted, along the longitudinal path of travel as seen in FIG. 10, and withdrawn from the case member 22 to detach the ends 30 and 40 of the necklace 32. Release of the knob 90 will enable U-shaped compression spring 70 to return latch 150 to the latching position in the path of travel of web 130 for a subsequent capture of the blade member 24 within the case member 22 upon selected re-attachment.

It is noted that the resilient biasing force exerted by leaf spring 78 need by only great enough to assure that latch 150 is biased into notch 154 in position to coact with shoulder 156 to keep blade member 24 captured within case number 22. Thus, the capturing force is independent of the biasing force exerted by leaf spring 78 and that biasing force may be made light enough to ease the insertion of blade member 24 into case member 22 and the advancement of the blade member 24 against the resilient biasing force of leaf spring 78. On the other hand, the biasing force of U-shaped compression spring 70 may be made greater so as to resist inadvertent withdrawal of latch 150 from notch 154. Thus, the resilient biasing force of U-shaped compression spring 70 may be made great enough so that only a deliberate forceful torque exerted upon knob 90 will result in the withdrawal of latch 150 from notch 154 and concomitant release of the blade member 24 for retraction and disconnection from case member 22. The construction of multi-purpose spring member 60 enables the attainment of both the relatively heavy biasing force of compression spring 70 and the relatively lighter biasing force of leaf spring 78 in a unitary spring member. Thus, the relatively long cantilever arm 74 is thin in the altitudinal direction and permits altitudinal deflection of end 80 with minimal resistance. However, cantilever arm 74 has a much greater lateral width and lateral deflection of cantilever arm 74 is resisted with great strength. Thus, the lateral force exerted upon cantilever arm 74 by knob 90, through finger 100, is transmitted to the compression spring 70, which is large enough to provide a stronger resistive force, thereby requiring a greater force to retract latch 150 laterally from notch 154. In this manner, the single, one-piece spring member 60 provides two independent resilient biasing forces of different magnitudes for optimum performance in the different modes of operation of the jewelry clasp 20. In addition, spring member 60 is provided with a post 168 which projects upwardly from the root 76 of cantilever arm 74 and extends behind the platform 64. Should severe longitudinal forces be exerted upon blade member 24, when the blade member 24 is captured within the case member 22 in the engaged position, tending to retract the blade member 24 by pulling longitudinally on the cantilever arm 74 against the resistance of the U-shaped segment of compression spring 70, deflection of the U-shaped segment of compression spring 70 in that longitudinal direction is precluded by the abutment of post 168 against platform 64 at 169.

In order positively to preclude inadvertent detachment of the blade member 24 from the case member 22, jewelry clasp 20 is provided with a safety lock. As best seen in FIGS. 7, 8, 11 and 12, as well as in FIGS. 1, 2 and 3, sliding safety lock member 120 slides within longitudinal grooves 170 and 172 provided at the side walls 110, 112, 160 and 162 of the lower and upper casing portions 52 and 54, between an unlocked position, shown in FIGS. 1, 7 and 8, and a locked position, shown in FIGS. 2, 11 and 12. Pad 124 of lock member 120 includes a raised ridge 174 providing an abutment 176. When the lock member 120 is in the unlocked position, abutment 176 is located forward of the end 80 of cantilever arm 74 and lateral movement of end 80 is permitted, as described above in connection with the selective disengagement of latch 150 from notch 154. However, when lock member 120 is in the locked position, abutment 176 is located alongside the cantilever arm 74 and precludes such lateral movement of end 80 and disengagement of latch 150 from notch 154.

Figure 11:
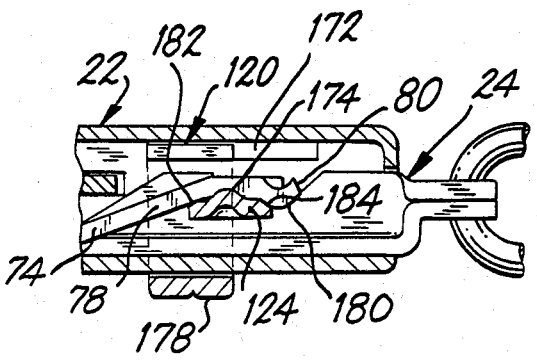
FIG. 11 is a fragmentary view of a portion of FIG. 7, but with component parts in a locked position.
Figure 12:
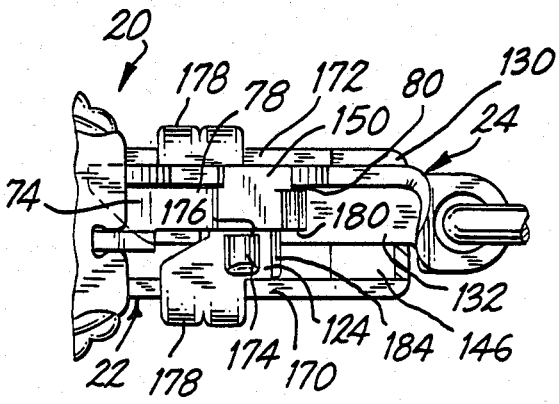
FIG. 12 is a fragmentary view of a portion of FIG. 8, but with component parts in the locked position of FIG. 11.

Selective movement of the lock member 120 between the locked and unlocked positions is accomplished readily merely by gripping some or all of the finger-grip portions 178 at each side and along the bottom of the lock member 120 and sliding the lock member 120 along the case member 22 to one or the other of the positions. A detent arrangement retains the lock member 120 in either of these selected positions. Thus, cantilever arm 74 is provided with a detent protrusion 180 adjacent end 80 thereof and pad 124 is provided with laterally-extending rearward and forward beveled edges 182 and 184. When lock member 120 is in the forward, unlocked position, as seen in FIGS. 1, 7 and 8, detent protrusion 180 engages rearward beveled edge 182 of pad 124 and retains lock member 120 in the unlocked position. When lock member 120 is in the locked position, as seen in FIGS. 2, 11 and 12, detent protrusion 180 engages forward beveled edge 184 and retains the lock member 120 in the locked position. The resilient biasing force of leaf spring 78 biases the detent protrusion 180 into the desired engagement for operation of the detent arrangement, while the beveled edges 182 and 184 facilitate selective release of the detent engagement when the lock member 120 is moved from one position to the other.

It is noted that while the lock member 120 precludes lateral displacement of the latch 150 out of the path of travel of the web 130 of blade member 24, when the lock member 120 is in the locked position, altitudinal displacement of the latch 150 is not precluded. Thus, enagagement and capture of the blade member 24 within the case member 22 is accomplished regardless of the position of the lock member 120. However, disengagement is permitted only when the lock member 120 is in the unlocked position. Therefore, the safety lock arrangement does not get in the way of convenient attachment of the ends 30 and 40 of necklace 32, since attachment is accomplished independent of the position of lock member 120. Hence, lock member 120 not only is unobtrusive and aesthetically compatible with the remainder of jewelry clasp 20, but the lock member is easy to use and does not detract from the ease of attachment of the members of the clasp. Moreover, the simple, unobtrusive arrangement of the safety lock enables the maintenance of the compact nature of clasp 20.

The overall construction of jewelry clasp 20 enables economy of manufacture as well as ease of operation and long life. Thus, the case member 22 readily is manufactured of any one of a plurality of materials, including precious or semi-precious metals, while the multi-purpose spring member 60 provides a single component part to be constructed of a spring material for positive and accurate operation over a long service life. The case member 22 may be ornamented, as desired, and need not be relied upon for the mechanical functions performed by the spring member 60. The spring member 60 may be made rugged, without concern for aesthetic considerations since the spring member 60 is fully encased. Economy is obtained through incorporating only one component part which supplies the various spring forces for operation of the latching mechanism and the safety lock mechanism, even though latching can be attained independent of the safety lock.

It is to be understood that the above detailed description of a preferred embodiment of the invention is provided by way of example only. Various details of design and construction may be modified without departing from the true spirit and scope of the invention, as set forth in the appended claims.

The embodiments of the invention in which an exclusive property or privilege is claimed are defined as follows:

1. A jewelry clasp for securing together and selectively releasing opposed portions of a jewelry strand, said clasp comprising:

a first clasp member for being affixed to one of said opposed portions;

a second clasp member for being affixed to the other of said opposed portions, the second clasp member being receivable within the first clasp member and movable longitudinally along a path of travel extending into the first clasp member, for advancement to an engaged position where the second clasp member is captured and secured against retraction from the first clasp member, and for selective retraction from the engaged position;

a retainer within the first clasp member, the retainer normally located in a latched position within said path of travel and displaceable out of said path of travel in an altitudinal direction transverse to the longitudinal direction, and in a lateral direction transverse to each of the longitudinal direction and the altitudinal direction;

first resilient biasing means biasing the retainer in the altitudinal direction toward the latched position with a first resilient biasing force;

second resilient biasing means biasing the retainer in the lateral direction toward the latched position with a second resilient biasing force;

displacement means on the second clasp member for engaging the retainer to displace the retainer out of said path of travel in said altitudinal direction, against the first resilient biasing force, in response to advancement of the second clasp member toward the engaged position;

a keeper on the second clasp member for receiving the retainer upon arrival of the second clasp member at the engaged position and return of the retainer to the latched position in response to the first resilient biasing force; and an actuator mounted for movement on the first clasp member and coupled with the retainer for selective displacement of the retainer out of said path of travel in said lateral direction, against the second resilient biasing force, for selectively disengaging the retainer from the keeper and freeing the second clasp member for retraction from the first clasp member to release the opposed portions of the jewelry strand.

2. The invention of claim 1 wherein the second resilient biasing force is greater than the first resilient biasing force.

3. The invention of claim 1 wherein the longitudinal, altitudinal and lateral directions are mutually perpendicular.

4. The invention of claim 3 wherein the second resilient biasing force is greater than the first resilient biasing force.

5. The invention of claim 1 including a lock member mounted upon the first clasp member for selective movement between a locked position and an unlocked position, the lock member having an abutment, the abutment being placed relative to the retainer, when the lock member is in the locked position, to preclude lateral displacement of the retainer out of engagement with the keeper, and the abutment being placed relative to the retainer, when the lock member is in the unlocked position, to enable such lateral displacement of the retainer.

6. The invention of claim 5 wherein the abutment is placed relative to the retainer, when the lock member is located in either one of the locked position and the unlocked position, to enable said displacement of the retainer in the altitudinal direction out of said path of travel in response to advancement of the second clasp member toward the engaged position.

7. The invention of claim 6 including detent means for holding the lock member at the selected one of the locked position and the unlocked position.

8. The invention of claim 1 wherein the actuator is mounted for rotation about an altitudinal axis of rotation to move the actuator against the second resilient biasing force.

9. The invention of claim 8 wherein the second resilient biasing force is greater than the first resilient biasing force.

10. The invention of claim 1 wherein the second clasp member includes a blade member having a longitudinallyextending altitudinal web having a forward terminal end, the keeper includes an altitudinally-extending shoulder on the web, and the displacement means includes a ramp between the forward terminal end and the shoulder.

11. The invention of claim 10 wherein the blade member includes a lateral flange integral with the web such that the blade member has an L-shaped cross-sectional configuration, and the first clasp member includes an L-shaped opening complementary to the L-shaped cross-sectional configuration for receiving the blade member within the first clasp member.

12. The invention of claim 1 wherein:

the retainer includes a latch;

the first resilient biasing means includes a leaf spring extending longitudinally along the first clasp member for deflection in said altitudinal direction and coupled with the latch; and the second resilient biasing means includes a compression spring extending for deflection in said lateral direction and coupled with the latch.

13. The invention of claim 12 including a spring member, the leaf spring comprising an altitudinally deflectable portion of the spring member and the compression spring comprising a laterally compressible portion of the spring member.

14. The invention of claim 13 wherein the altitudinally deflectable portion includes a cantilever arm and the laterally compressible portion includes a U-shaped segment, the cantilever arm being integral with the U-shaped segment.

15. The invention of claim 14 wherein the cantilever arm is unitary with the U-shaped segment.

16. The invention of claim 15 wherein the spring member includes pivot means and the actuator is mounted for rotation upon the pivot means.

17. The invention of claim 16 wherein the actuator includes a knob and the pivot means mounts the knob for rotation about an altitudinal axis.

18. The invention of claim 17 including coupling means coupling the knob with the cantilever arm for lateral movement of the cantilever arm in response to rotation of the knob, the coupling means enabling altitudinal deflection of the cantilever arm independent of the rotation of the knob.

19. The invention of claim 18 wherein the second resilient biasing force is greater than the first resilient biasing force.

* * * * *